US009134038B2

(12) United States Patent
Lee et al.

(10) Patent No.: US 9,134,038 B2
(45) Date of Patent: Sep. 15, 2015

(54) LINEAR RESET PROVIDING ADAPTIVE RESPONSE AND CONTROL ACTION REVERSAL OF PID LOOPS

(75) Inventors: Anthony N. Lee, Stacy, MN (US); Joel D. Monroe, Brooklyn Center, MN (US)

(73) Assignee: Trane International Inc., Piscataway, NJ (US)

( * ) Notice: Subject to any disclaimer, the term of this patent is extended or adjusted under 35 U.S.C. 154(b) by 1331 days.

(21) Appl. No.: 12/798,033

(22) Filed: Mar. 29, 2010

(65) Prior Publication Data

US 2011/0232891 A1 Sep. 29, 2011

(51) Int. Cl.
*F24F 3/14* (2006.01)
*F24F 11/00* (2006.01)

(52) U.S. Cl.
CPC ..... *F24F 3/1423* (2013.01); *F24F 11/006* (2013.01)

(58) Field of Classification Search
CPC ..... F24F 3/14; F24F 7/00; F24F 11/008; F24F 2003/1458; F24F 2003/1464; F24F 2011/0046; F24F 2011/0047; F24F 2011/0082; F24F 2203/1032; F25B 29/00; F25B 15/00
USPC ..... 165/222, 271, 59, 63; 62/271
See application file for complete search history.

(56) References Cited

U.S. PATENT DOCUMENTS

| | | | |
|---|---|---|---|
| 4,719,761 | A | 1/1988 | Cromer |
| 5,517,828 | A | 5/1996 | Calton et al. |
| 5,761,923 | A | 6/1998 | Maeda |
| 6,094,835 | A | 8/2000 | Cromer |
| 6,199,389 | B1 | 3/2001 | Maeda |
| 6,575,228 | B1 | 6/2003 | Ragland et al. |
| 6,973,795 | B1 | 12/2005 | Moffitt |

FOREIGN PATENT DOCUMENTS

WO WO 9905578 A1 * 2/1999

* cited by examiner

*Primary Examiner* — Travis Ruby
(74) *Attorney, Agent, or Firm* — William O'Driscoll

(57) ABSTRACT

An HVAC system for controlling the temperature and humidity of air supplied to a comfort zone includes a heater and a cooler operating concurrently. In response to a supply air temperature sensor, a PID control loop with substantially constant gain controls the cooler to maintain the zone air at a certain comfortable temperature. The heater, also under PID control, is controlled in response to a humidistat. To prevent the heater from overloading the cooler during periods of high cooling demand, a variable gain multiplier decreases the heater's gain when the cooler's output exceeds a predetermined limit; otherwise, the heater's gain remains substantially constant. When the cooler is operating above the predetermined limit, the multiplier varies linearly between positive-one and negative-one and does so inverse-proportionally with the cooling load to smoothly change the heater's PID control from direct acting to reverse acting as the cooler approaches its maximum capacity.

16 Claims, 3 Drawing Sheets

LINEAR RESET PROVIDING ADAPTIVE RESPONSE AND CONTROL ACTION REVERSAL OF PID LOOPS

BACKGROUND OF THE INVENTION

1. Field of the Invention

The subject invention generally pertains to heating ventilating air conditioning systems (HVAC systems) and more specifically to control schemes for such systems.

2. Description of Related Art

Heat exchangers, referred to herein as coolers, are used for cooling air supplied to a comfort zone, such as a room or other area of a building. The cooler not only cools the air but also helps dehumidify it. To achieve greater dehumidification without over-cooling the comfort zone, some systems include a heater that is activated along with the cooler. An example of such a system is disclosed in U.S. Pat. No. 6,973,795. Although such a system is effective, it can be challenging to coordinate the control of both a heater and a cooler to provide an appropriate balance of heating and cooling. In some attempts to lower humidity, for example, the heater might overload the cooler to a point where the cooler is unable to maintain a desired target temperature of the comfort zone.

SUMMARY OF THE INVENTION

It is an object of some embodiments of the invention to provide a temperature conditioning system with a control scheme for a heater and a cooler, wherein a gain multiplier for the heater is varied as a function of the cooler's operation.

Another object of some embodiments is to change the control of a heater from direct acting to reverse acting in response to the cooler approaching its maximum cooling capacity.

Another object of some embodiments is to control a cooler in response to a temperature sensor while controlling a heater in response to a humidistat.

Another object of some embodiments is to apply PID control to both a heater and a cooler, wherein the respective heater and cooler gains are substantially constant for the vast majority of their operating ranges; however, the heater gain only varies near the maximum operating point of the cooler while the cooler gain remains substantially constant over its entire range of operation.

In some embodiments, the present invention provides a temperature conditioning system for simultaneously heating and cooling a current of air flowing to and passing through a comfort zone, wherein the current of air includes a coolable current of air and a heatable current of air. The temperature conditioning system comprises a heater connected in heat transfer relationship with the heatable current of air with a heat regulator connected to adjust a heat output of the heater. The system also includes a cooler connected in heat transfer relationship with the coolable current of air with a cooling regulator connected to adjust a cooling capacity of the cooler. The cooling regulator provides the cooler with a range of capacities including a maximum cooling capacity, a minimum cooling capacity, and a predetermined intermediate cooling capacity therebetween. The system further includes a sensor system exposed to the current of air. The sensor system provides a feedback signal representative of a thermodynamic condition of the current of air. Examples of the thermodynamic condition include, but are not limited to, comfort zone air temperature, supply air temperature, absolute humidity, relative humidity, etc. The system also includes a control system connected in signal communication with the sensor system, the heat regulator and the cooling regulator. The control system has a cooler control loop to control the cooling regulator. The control system has a heater control loop with a heater gain to control the heat regulator, wherein the heater gain varies more when the cooler is between the predetermined intermediate cooling capacity and the maximum cooling capacity than when the cooler is between the predetermined intermediate cooling capacity and the minimum cooling capacity.

In some embodiments, the present invention provides a temperature conditioning system for simultaneously heating and cooling a current of air flowing to and passing through a comfort zone, wherein the current of air includes a coolable current of air and a heatable current of air. The temperature conditioning system comprises a heater connected to convey the warm fluid therethrough to place the warm fluid in heat transfer relationship with the heatable current of air. A warm fluid flow adjustor is connected in fluid communication with the heater to control the warm fluid flowing through the heater. A cooler is connected to convey the cool fluid therethrough to place the cool fluid in heat transfer relationship with the coolable current of air. A cool fluid flow adjustor is connected in fluid communication with the cooler to control the cool fluid flowing through the cooler. The cool fluid flow adjustor has a range of flow modes including a maximum flow mode, a minimum flow mode, and a predetermined intermediate flow mode therebetween. A blower is positioned to force the current of air sequentially through the heater and the cooler, so the heatable current of air passes through the heater, and the coolable current of air passes through the cooler. A desiccant wheel is exposed to the current of air. The desiccant wheel being rotatable to rotate generally opposite radial ends of the wheel between the heatable current of air and the coolable current of air. A sensor system is exposed to the current of air. The sensor system provides a feedback signal representative of a thermodynamic condition of the current of air. A control system is connected in signal communication with the sensor system, the warm fluid flow adjustor and the cool fluid flow adjustor. The control system has a heater control loop with a heater gain to control the warm fluid flow adjustor. The control system has a cooler control loop with a cooler gain to control the cooler fluid flow adjustor. The heater gain varies more when the cooler flow adjustor is between the predetermined intermediate mode and the maximum flow mode than when the cooler flow adjustor is between the predetermined intermediate flow mode and the minimum flow mode.

In some embodiments, the present invention provides a temperature conditioning method for simultaneously heating and cooling a current of air. The current of air provides a coolable current of air and a heatable current of air. The current of air flows to and passes through a comfort zone. The temperature conditioning method comprises heating the heatable current of air; controlling the heating via a heating control loop that has a variable gain; cooling the coolable current of air; varying the cooling over a range of capacities that includes a minimum cooling capacity, a maximum cooling capacity and a predetermined intermediate cooling capacity therebetween; and adjusting the variable gain more noticeably when operating between the predetermined intermediate cooling capacity and the maximum cooling capacity than when operating between the predetermined intermediate cooling capacity and the minimum cooling capacity.

DESCRIPTION OF THE PREFERRED EMBODIMENT

Figure 1:
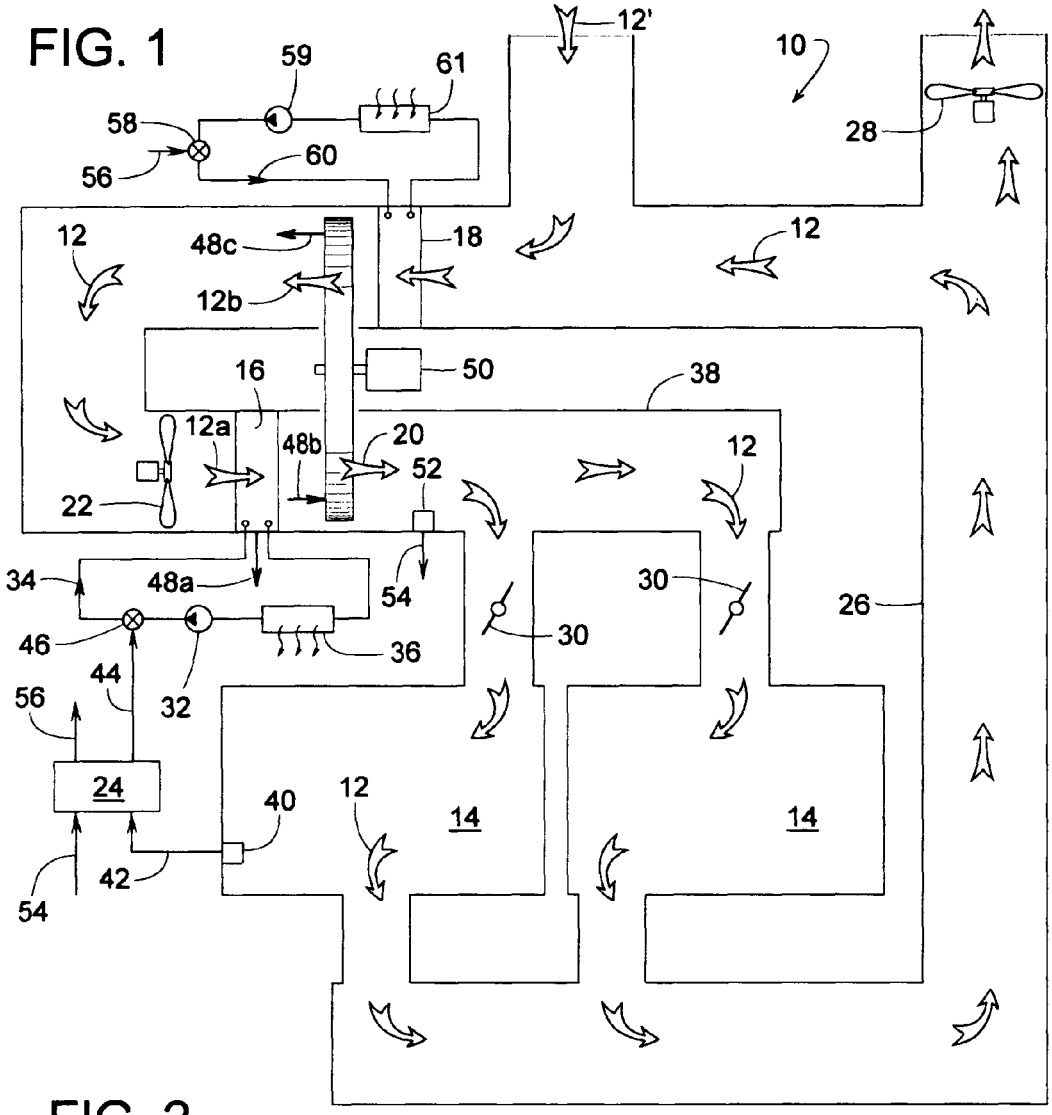
FIG. 1 is a schematic diagram of a temperature conditioning system according to one example of the present invention.

FIG. 1 schematically illustrates one example of a temperature conditioning system 10 for conditioning a current of air 12 supplied to one or more comfort zones 14, such as rooms or other areas of a building. In this example, system 10 comprises a cooler 16 for cooling and/or dehumidifying air 12, a heater 18 for reducing the relative humidity of air 12, an active desiccant wheel 20 for transferring moisture from one air stream to another, and a blower 22. Blower 22 forces force air 12 through heater 18, wheel 20, cooler 16 and comfort zones 14. A controller 24 with a novel control scheme controls the heat transfer rates of cooler 16 and heater 18. A return air duct 26 returns air to heater 18 and/or an exhaust air blower 28, wherein blower 28 can be used to force some exchange of indoor air 12 with fresh outside air 12'. Variable air volume valves 30 can be independently controlled to apportion conditioned air 12 from cooler 16 to zones 14 as needed.

Cooler 16 is schematically illustrated to represent any heat exchanger capable of cooling air 12. A coolable air current 12*a* is the segment of air current 12 that is cooled by cooler 16. Examples of cooler 16 include, but are not limited to, a finned tube heat exchanger, a stacked plate or microchannel heat exchanger, a coil, an evaporator of a refrigerant circuit, etc. Heater 18 is schematically illustrated to represent any heat exchanger capable of heating air 12. A heatable air current 12*b* is the segment of air current 12 that is heated by heater 18. Examples of heater 18 include, but are not limited to, a finned tube heat exchanger, a stacked plate or microchannel heat exchanger, a coil, a condenser of a refrigerant circuit, an electric resistance heating element, etc.

For sake of example, system 10 will be described with reference to cooler 16 and heater 18 being coils or finned tube heat exchangers. To cool air current 12, a pump 32 circulates a cool fluid 34 between cooler 16 and a chilled fluid source 36. The term, "cool" means cooler than air current 12*a*. Examples of fluid 34 include, but are not limited to, water, glycol, water/glycol mixtures, and refrigerant. The tubes of cooler 16 convey cool fluid 34 while air current 12*a* flows across the exterior of the tubes, thereby placing air current 12*a* in heat transfer relationship with cool fluid 34. A supply air duct 38 conveys the cooled air current 12*a* to comfort zones 14.

To regulate the supply air temperature, one or more temperature sensors 40 sensing cool air current 12*a* and/or the room temperature of one or more comfort zones 14 provide a feedback signal 42 to controller 24, which in response thereto provides a cooling output signal 44 that controls the degree of opening of a cooler valve 46, which in turn controls the flow rate of cool fluid 34 through cooler 16. Valve 46 comprises not only a closing element (e.g., valve plug) and its element seat but also a conventional actuator that moves the closing element. Through output signal 44, controller 24 can vary the opening of valve 46 over a range of positions including, for example, completely closed or minimally open (minimum flow mode) for minimum or zero cooling capacity, fully or nearly fully open (maximum flow mode) for maximum cooling capacity, and various intermediate open positions therebetween.

In this example, controller 24 is a microprocessor based controller applying a PID or proportional-integral-derivative control loop, wherein output signal 44 is based on the following equation: delta-output(n)=[K1×delta-error(n)]+[K2×error(n)]+[K3×delta-squared-error(n)]. In this equation, delta-output(n) is the incremental change in output signal 44 at each step-n, K1 is a proportional gain constant, K2 is an integral gain constant, K3 is a derivative gain constant, error(n) is the difference at step-n between the target air temperature and the actual air temperature as measured by temperature sensor 40, delta-error(n) is the change in error at step-n, and delta-squared-error(n) is the change in delta-error at step-n, and "n" represents the step or number of executions. The constants K1, K2 and K3 can be various numbers (positive, negative or zero) chosen to achieve a desired response with the particular system to which it is applied.

Condensate 48*a* draining from cooler 16 removes moisture from air current 12*a*, thus cooler 16 helps dehumidify the air supplied to comfort zones 14. For greater dehumidification of comfort zones 14 without overcooling them, heater 18 and desiccant wheel 20 can be activated along with cooler 16. When a motor 50 rotates wheel 20 so that opposite radial ends of wheel 20 rotate between air currents 12*a* and 12*b* while cooler 16 and heater 18 are active, wheel 20 absorbs additional moisture 48*b* from air current 12*a*. As wheel 20 rotates, wheel 20 later releases the absorbed moisture as indicated by the arrow representing moisture 48*c* being released to the relatively dry air current 12*b*. The relative humidity of air current 12*b* has been reduced by heater 18 raising the temperature and thus increasing the moisture-holding capacity of air current 12*b*. As air current 12 passes through cooler 16, at least some of moisture 48*c* condenses on cooler 16 and drains therefrom as additional condensate 48*a*, thus further dehumidifying the air.

To control the humidity, one or more humidity sensors 52 sensing air 12 flowing to or through comfort zones 14 provide a feedback signal 54 to controller 24, which in response thereto provides a heating output signal 56 that controls the degree of opening of a heater valve 58. Valve 58, in turn, controls the flow rate of a warm fluid 60 that a pump 59 circulates between a warm fluid source 61 and heater 18. The term, "warm" means warmer than air current 12*b*. One or more humidity sensors 52 and/or one or more temperature sensors 40 are considered herein as a "sensor system." As for the warm fluid flowing through heater 18, examples of fluid 60 include, but are not limited to, water, glycol, water/glycol mixtures, and refrigerant. The tubes of heater 18 convey warm fluid 60 while air current 12*b* flows across the exterior of the tubes, thereby placing air current 12*b* in heat transfer relationship with warm fluid 60. Through output signal 56, controller 24 varies the opening of valve 58 to adjust the heat output of heater 18 to achieve a desired humidity level or reading from feedback signal 54.

Figure 2:
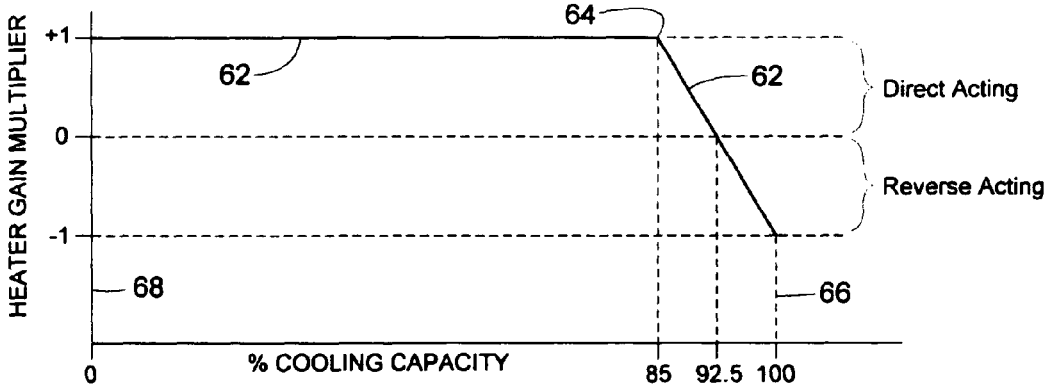
FIG. 2 is a graph showing a heater gain multiplier changing as a function of a cooler's rate of cooling.

In some embodiments of the invention, controller 24 generates output signal 56 based on the following equation: delta-output(n)=M×{[C1×delta-error(n)]+[C2×error(n)]+[C3×delta-squared-error(n)]}. In this equation, delta-output(n) is the incremental change in output signal 56 at each step-n, C1 is a proportional gain constant, C2 is an integral gain constant, C3 is a derivative gain constant, error(n) is the difference at step-n between the target humidity and the actual humidity as measured by humidity sensor 52, delta-error(n) is the change in error at step-n, and delta-squared-error(n) is the change in delta-error at step-n, and "n" represents the step or number of executions. The constants C1, C2 and C3 can be various numbers (positive, negative or zero) chosen to achieve a desired response with the particular system to which it is applied. In some examples, for instance, C3 equals zero. The term, "M," is a heater gain multiplier 62 (heater gain or variable heater gain) having a value that varies based on the cooling rate of cooler 16 or the extent to which the cooler's valve 46 is open. Strategically varying the value of heater gain multiplier 62 provides a means for preventing heater 18 from overheating air 12 to an extent that cooler 16 would be overloaded and unable to maintain air 12 at the desired target temperature. The equation, delta-output(n)=M×{[C1×delta-error(n)]+[C2×error(n)]+[C3×delta-square-error(n)]}can be rearranged as M={delta-output(n)}/{[C1×delta-error(n)]+[C2×error(n)]+[C3×delta-squared-error(n)]}, wherein the heater gain of M is expressed as ratio with the numerator being a delta-output and the denominator being a delta-input. The delta-output is an incremental change in heating output signal 56 as some given operating point of system 10, 10' or 10", and the delta-input is an incremental change in feedback signal 54. The operating point can be any discrete area within a rang of operating points between 0% and 100% cooling capacity, as shown in FIG. 2. It should be noted in FIG. 2 that the horizontal section of line 62 extends over a first cooling range of 0% to 85%, and an inclined section of line 62 extends over a second cooling range of 85% to 100%. It should also be noted that heater gain62 varies from positive one to negative one over the second cooling range, and is substantially constant at plus one over the first cooling range.

For the example illustrated in FIG. 2, heater gain multiplier 62 is substantially constant and equal to positive-one when the cooler's valve 46 is no more than 85% open to meet low to moderate cooling loads. The 85% point 64, in this example, is a predetermined intermediate flow mode that provides cooler 16 with a predetermined intermediate cooling capacity. When valve 46 opens more than 85% to meet higher cooling loads, multiplier 62 decreases linearly from positive-one (valve 46 at 85% open) to negative-one (valve 46 100% open). In this example, multiplier 62 equals zero when valve 46 is open 92.5%. When the cooler's valve 46 shifts from being less than to greater than 92.5% open, the control of heater valve 58 shifts from direct acting to reverse acting. The decreasing gain or decreasing response of heater valve 58 as cooler valve 46 opens from 85 to 92.5% and the negative gain or reverse acting response of heater valve 58 when cooler valve 46 is open more than 92.5% prevents heater 18 from delivering more heat to air 12 than what cooler 16 can handle.

It should be appreciated that the particular values of 85% and 92.5% are only examples and other reasonable values are certainly within the scope of the invention. However, since the idea is to prevent overloading cooler 16, the predetermined intermediate flow mode to provide the predetermined intermediate cooling capacity should be closer to the maximum cooling capacity than to the minimum cooling capacity, as shown in the example of FIG. 2, wherein the predetermined intermediate flow mode of 85% (point 64) and the predetermined intermediate cooling capacity of 85% (point 64) are in fact closer to the maximum value of 100% (line 66) than to the minimum value of 0% (line 68). Moreover, multiplier 62 does not have to be perfectly constant and equal to one when valve 46 is open less than a predetermined degree, and multiplier 62 does not have to decrease necessarily linearly as valve 46 opens beyond the predetermined degree.

Figure 3:
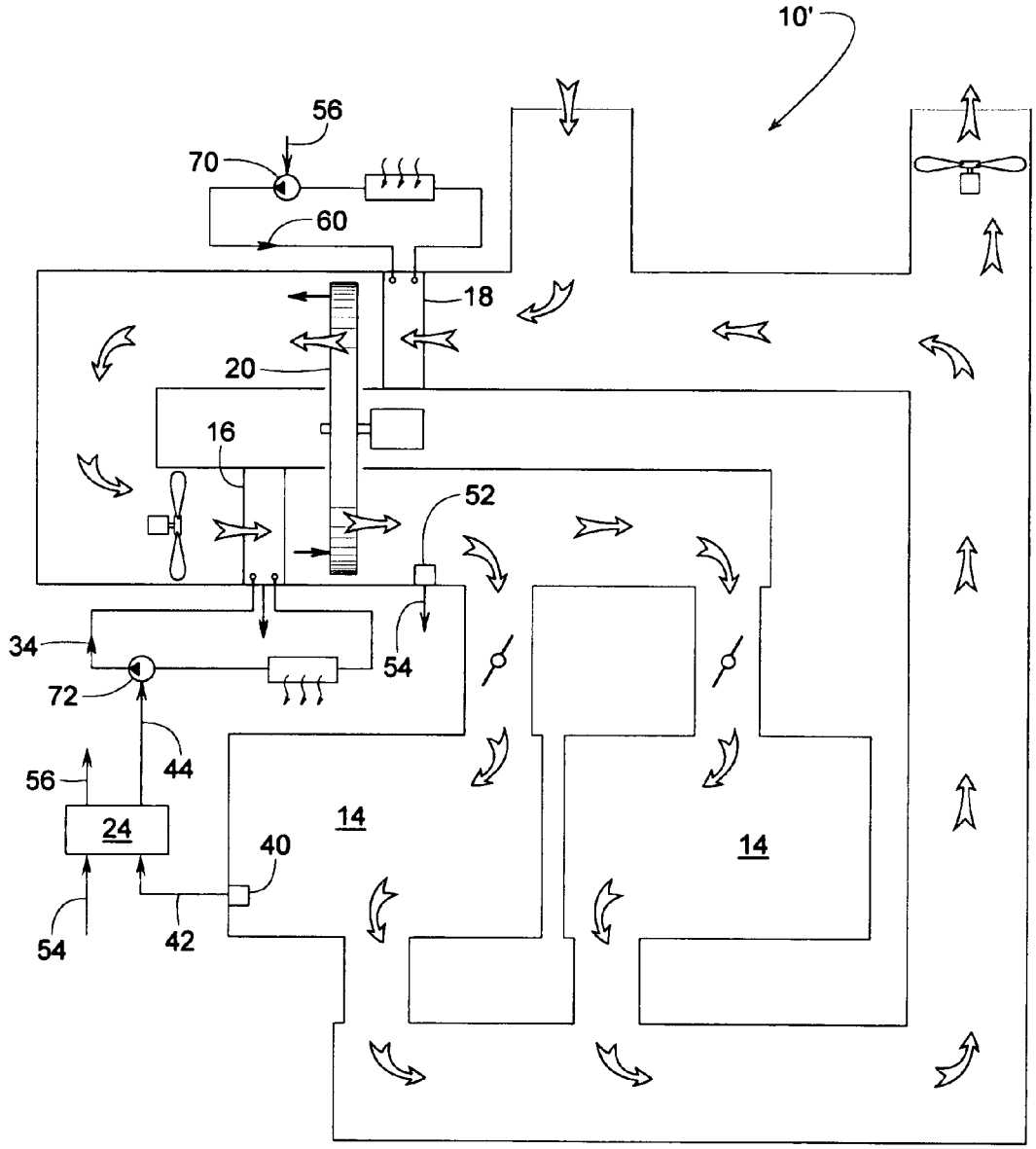
FIG. 3 is a schematic diagram of another example temperature conditioning system.

In the example shown in FIG. 3, a temperature conditioning system 10' includes a pump 70 driven at variable speed to replace valve 58 as the warm fluid adjustor or heat regulator of heater 18. System 10' also includes a pump 72 driven at variable speed to replace valve 46 as the cool fluid flow adjustor or cooler regulator. Through output signal 44, in this example, controller 24 varies the speed of pump 72 over a range of speeds including, for example, zero or near zero speed (minimum flow mode) for minimum or zero cooling capacity, full speed (maximum flow mode) for maximum cooling capacity, and various intermediate speeds therebetween.

Similar to system 10, output signal 44 still is based on the following equation: delta-output(n)=[K1×delta-error(n)]+[K2×error(n)]+[K3×delta-squared-error(n)]. Also, in this example, controller 24 generates output signal 56 based on the equation: delta-output(n)=M×{[C1×delta-error(n)]+[C2×error(n)]+[C3×delta-squared-error(n)]}.

Instead of driving valve actuators, however, output signals 44 and 56 command the operation of variable speed drives connected to the motors of pumps 72 and 70. Similar to system 10, heater gain multiplier 62 varies as shown in FIG. 2, wherein gain multiplier 62 is substantially constant and equal to positive-one when pump 72 is running at no more than 85% full speed to meet low to moderate cooling loads. When the speed of pump 72 is greater than 85% full speed to meet higher cooling loads, multiplier 62 decreases linearly from positive-one (85% full speed) to negative-one (pump 72 at 100% full speed). In this example, multiplier 62 equals zero when pump 72 is driven at 92.5% of full speed.

Figure 4:
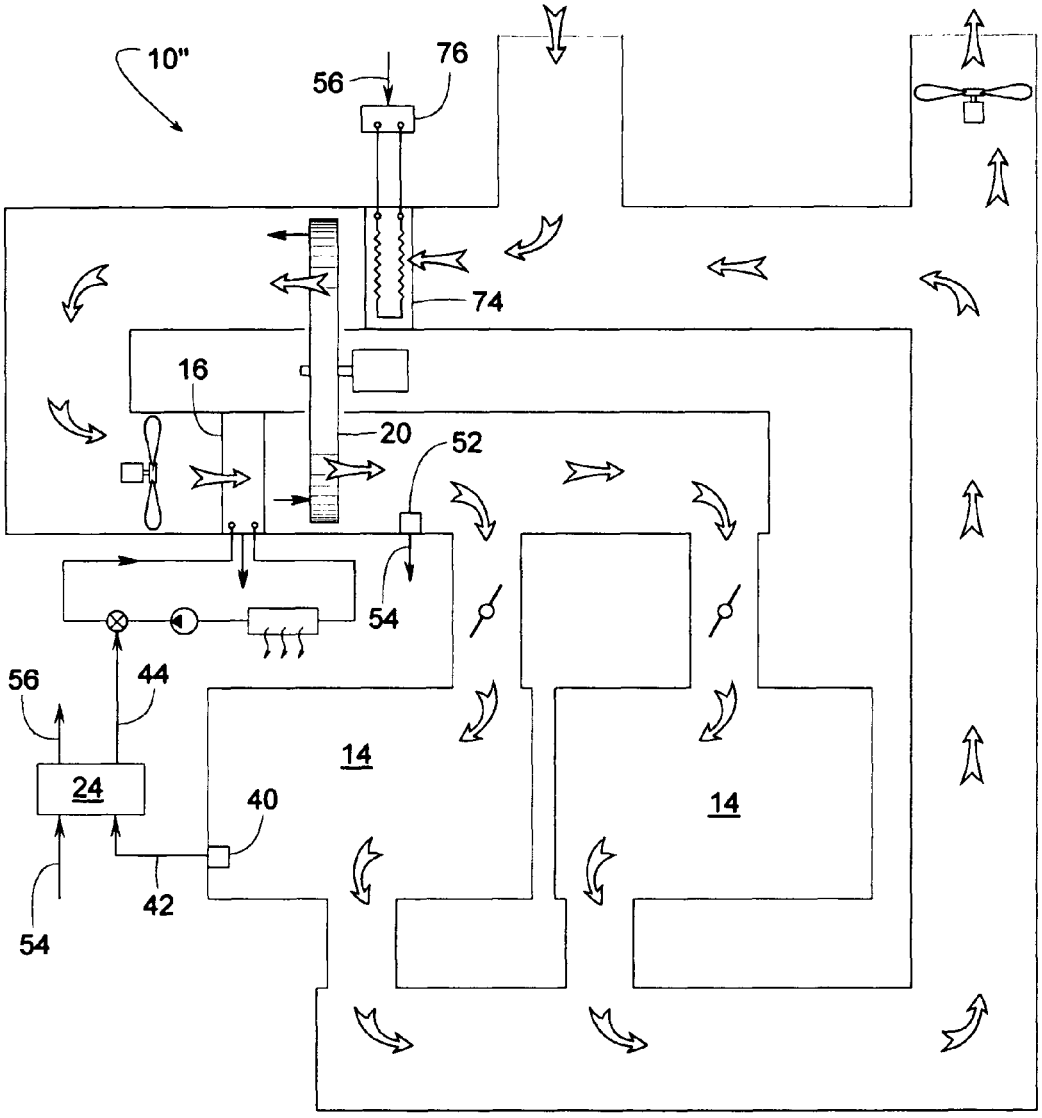
FIG. 4 is a schematic diagram of yet another example temperature conditioning system.

In another example, shown in FIG. 4, a temperature conditioning system 10" is similar to system 10 of FIG. 1; however, system 10" includes an electric heater 74 that replaces heater 18, pump 59 and valve 58. Otherwise, systems 10 and 10" are the basically the same in structure and function. To vary the heat output of heater 74, output signal 56 controls the electrical power from the heater's variable power supply 76, thus variable power supply 76 serves as a heat regulator for heater 74. The electrical power varies over a range of power levels from zero or near zero power for minimum heat capacity to full power for maximum heating capacity.

Similar to system 10, output signal 44 still is based on the equation: delta-output(n)=[K1×delta-error(n)]+[K2×error(n)]+[K3×delta-squared-error(n)]. Also, in this example, controller 24 generates output signal 56 based on the equation: delta-output(n)=M×{[C1×delta-error(n)]+[C2×error(n)]+[C3×delta-squared-error(n)]}, wherein the term, "M" or heater gain multiplier 62 varies as shown in FIG. 2.

Referring to FIGS. 1 and 2, air 12*b* passing across heater 18 represents heating the heatable current of air 12. Controller 24, heater gain multiplier 62 of FIG. 2, and the equations mentioned herein represent controlling the heating via a heating control loop having a variable gain. Air 12*a* passing across cooler 16 represents cooling the coolable current of air. Controller 24, output signal 44, and FIG. 2 represent varying the cooling over a range of capacities that includes a minimum cooling capacity, a maximum cooling capacity and a predetermined intermediate cooling capacity therebetween. The graph of FIG. 2 represents adjusting the variable gain more noticeably when operating between the predetermined intermediate cooling capacity and the maximum cooling capacity than when operating between the predetermined intermediate cooling capacity and the minimum cooling capacity. The graph of FIG. 2 represents maintaining the variable gain substantially constant when operating between the minimum cooling capacity and the intermediate cooling capacity. The graph of FIG. 2 represents changing operation from the predetermined intermediate cooling capacity to the maximum cooling capacity and changing a polarity of the variable gain upon changing from the predetermined intermediate cooling capacity to the maximum cooling capacity. Arrows 48*b* and 48*c* of FIG. 1 represents transferring moisture from the coolable current of air to the heatable current of air.

Although the invention is described with respect to a preferred embodiment, modifications thereto will be apparent to those of ordinary skill in the art. Outputs 44 and 56, for example, are described as incremental outputs; however, converting those outputs to absolute or cumulative rather than incremental is certainly within the scope of the invention. The scope of the invention, therefore, is to be determined by reference to the following claims:

The invention claimed is:

1. A temperature conditioning system for simultaneously heating and cooling a current of air, the current of air provides a coolable current of air and a heatable current of air, the current of air flowing to and passing through a comfort zone, the temperature conditioning system comprising:

a heater connected in heat transfer relationship with the heatable current of air;

a heat regulator connected to adjust a heat output of the heater;

a cooler connected in heat transfer relationship with the coolable current of air;

a cooling regulator connected to adjust a cooling capacity of the cooler, the cooling regulator providing the cooler with a range of capacities including a maximum cooling capacity, a minimum cooling capacity, and a predetermined intermediate cooling capacity therebetween;

the cooler having a first cooling range between the minimum cooling capacity and the intermediate cooling capacity;

the cooler having a second cooling range between the intermediate cooling capacity and the maximum cooling capacity;

a sensor system exposed to the current of air, the sensor system providing a feedback signal representative of a thermodynamic condition of the current of air; and a control system connected in signal communication with the sensor system, the heat regulator and the cooling regulator; the control system having a cooler control loop to control the cooling regulator, the control system having a heater control loop with a heater gain to control the heat regulator, the heater gain varying as a function of the cooling capacity, the heater gain having a greater range of variance over the second cooling range than over the first cooling range, and the heater gain changing polarity as the cooler changes from the predetermined intermediate cooling capacity to the maximum cooling capacity.

2. The temperature conditioning system of claim 1, wherein the heat regulator is a valve adjusting a flow rate of a heated liquid flowing through the heater.

3. The temperature conditioning system of claim 1, wherein the heater gain is substantially constant when the cooler is between the minimum cooling capacity and the predetermined intermediate cooling capacity.

4. The temperature conditioning system of claim 1, wherein the heater control loop is a Proportional-Integral-Derivative loop.

5. The temperature conditioning system of claim 1, wherein predetermined intermediate cooling capacity is closer to the maximum cooling capacity than to the minimum cooling capacity.

6. The temperature conditioning system of claim 1, wherein the sensor system comprises an air temperature sensor and a humidistat.

7. The temperature conditioning system of claim 1, wherein the minimum cooling capacity is substantially equal to zero.

8. A temperature conditioning system for transferring heat from a warm fluid to a current of air and for transferring heat from the current of air to a cool fluid, the current of air provides a coolable current of air and a heatable current of air, the current of air flowing to and passing through a comfort zone, the temperature conditioning system comprising:

a heater connected to convey the warm fluid therethrough to place the warm fluid in heat transfer relationship with the heatable current of air;

a warm fluid flow adjustor connected in fluid communication with the heater to control the warm fluid flowing through the heater;

a cooler connected to convey the cool fluid therethrough to place the cool fluid in heat transfer relationship with the coolable current of air, the cooler having a range of cooling capacities extending over a first cooling range and a second cooling range;

a cool fluid flow adjustor connected in fluid communication with the cooler to control the cool fluid flowing through the cooler, the cool fluid flow adjustor having a range of flow modes including a maximum flow mode, a minimum flow mode, and a predetermined intermediate flow mode therebetween; the first cooling range being between the minimum flow mode and the predetermined intermediate flow mode, and the second cooling range being between the predetermined intermediate flow mode and the maximum flow mode;

a blower positioned to force the current of air sequentially through the heater and the cooler so the heatable current of air passes through the heater, and the coolable current of air passes through the cooler;

a desiccant wheel exposed to the current of air, the desiccant wheel being rotatable to rotate generally opposite radial ends of the desiccant wheel between the heatable current of air and the coolable current of air;

a sensor system exposed to the current of air, the sensor system providing a feedback signal representative of a thermodynamic condition of the current of air; and a control system connected in signal communication with the sensor system, the warm fluid flow adjustor and the cool fluid flow adjustor; the control system having a heater control loop with a heater gain to control the warm fluid flow adjustor, the control system having a cooler control loop with a cooler gain to control the cooler fluid flow adjustor, the heater gain varying based on the range of cooling capacities of the cooler such that the heater gain has a greater range of variance over the second cooling range between the predetermined intermediate flow mode and the maximum flow mode than over the first cooling range between the minimum flow mode and the predetermined intermediate flow mode, and the heater gain changing polarity as the cooler changes from the predetermined intermediate cooling capacity to the maximum cooling capacity.

9. The temperature conditioning system of claim 8, wherein the warm fluid flow adjustor is a first valve, and the cool fluid flow adjustor is a second valve.

10. The temperature conditioning system of claim 8, wherein the heater gain is substantially constant when the cool fluid flow adjustor is between the minimum flow mode and the predetermined intermediate flow mode.

11. The temperature conditioning system of claim 8, wherein the heater control loop is a Proportional-Integral-Derivative loop.

12. The temperature conditioning system of claim 8, wherein a flow rate of the cool fluid flowing through the cooler during the predetermined intermediate flow mode is closer to a maximum fluid flow rate during the maximum flow mode than to a minimum fluid flow rate during the minimum flow mode.

13. The temperature conditioning system of claim 8, wherein the sensor system comprises an air temperature sensor and a humidistat with the cool fluid flow adjustor varying in response to the temperature sensor and the warm fluid flow adjustor varying in response to the humidistat.

14. A temperature conditioning method for simultaneously heating and cooling a current of air, the current of air provides a coolable current of air and a heatable current of air, the current of air flowing to and passing through a comfort zone, the temperature conditioning method comprising:

heating the heatable current of air;

controlling the heating via a heating control loop having a variable heater gain;

cooling the coolable current of air;

varying the cooling over a range of capacities that includes a minimum cooling capacity, a maximum cooling capacity and a predetermined intermediate cooling capacity therebetween;

adjusting the variable heater gain such that the variable heater gain has a greater range of variance between the predetermined intermediate cooling capacity and the maximum cooling capacity than between the minimum cooling capacity and the predetermined intermediate cooling capacity;

changing operation from the predetermined intermediate cooling capacity to the maximum cooling capacity; and changing a polarity of the variable heater gain upon changing from the predetermined intermediate cooling capacity to the maximum cooling capacity.

15. The temperature conditioning method of claim 14, further comprising maintaining the variable heater gain substantially constant when operating between the minimum cooling capacity and the predetermined intermediate cooling capacity.

16. The temperature conditioning method of claim 14, further comprising transferring moisture from the coolable current of air to the heatable current of air.

* * * * *